US006550490B1

(12) United States Patent
Morton et al.

(10) Patent No.: US 6,550,490 B1
(45) Date of Patent: Apr. 22, 2003

(54) GRASPING ATTACHMENT FOR USE WITH A CANE

(76) Inventors: Jay Morton, 10228 Shireoaks La., Boca Raton, FL (US) 33498; Dianne Wagner Morton, 10228 Shireoaks La., Boca Raton, FL (US) 33498

( * ) Notice: Subject to any disclaimer, the term of this patent is extended or adjusted under 35 U.S.C. 154(b) by 0 days.

(21) Appl. No.: 10/006,912

(22) Filed: Nov. 29, 2001

(51) Int. Cl.[7] ..... A47B 3/00
(52) U.S. Cl. ..... 135/66; 135/84; 135/65
(58) Field of Search ..... 135/77, 66, 65, 135/84

(56) References Cited

U.S. PATENT DOCUMENTS

| | | | | | |
|---|---|---|---|---|---|
| 2,346,038 | A | * | 4/1944 | Mason | 294/19.1 |
| 3,467,116 | A | | 9/1969 | Ringwalt | |
| 3,527,492 | A | | 9/1970 | Hollis | |
| 3,591,226 | A | | 7/1971 | Elmore, Jr. | |
| 3,763,872 | A | | 10/1973 | Gooley | |
| 4,527,824 | A | | 7/1985 | Rosenfeld | |
| 4,811,780 | A | | 3/1989 | McAllister | |
| 4,827,956 | A | | 5/1989 | Toot | |
| 4,966,316 | A | | 10/1990 | George et al. | |
| 5,176,160 | A | | 1/1993 | Osborn | |
| 5,392,800 | A | | 2/1995 | Sergi | |
| 5,433,234 | A | * | 7/1995 | Lapere | 135/66 |
| 5,636,650 | A | | 6/1997 | Kroeze | |
| 5,640,985 | A | | 6/1997 | Snyder et al. | |
| 5,707,303 | A | | 1/1998 | Berkowitz et al. | |
| 6,065,787 | A | | 5/2000 | Jarosch | |

FOREIGN PATENT DOCUMENTS

| | | | | |
|---|---|---|---|---|
| CA | 551170 | * | 1/1958 | 135/77 |
| DE | 43 37 298 | * | 4/1995 | |
| FR | 2536639 | * | 6/1984 | 135/77 |
| GB | 2122077 | * | 1/1984 | 135/84 |

* cited by examiner

*Primary Examiner*—Janet M. Wilkens
(74) *Attorney, Agent, or Firm*—Ronald V. Davidge

(57) ABSTRACT

An apparatus is provided for use with a cane to facilitate picking up small objects from the floor. The apparatus, which is removably attachable to a cane, includes an actuator to be pivotally mounted near the handle of the cane, a grasping member pivotally mounted near the tip of the cane, and a cable mechanism, having a tubular sheath, extending along the cane to transmit motion between the actuator and the grasping member.

18 Claims, 2 Drawing Sheets

GRASPING ATTACHMENT FOR USE WITH A CANE

BACKGROUND TO THE INVENTION

1. Field of the Invention

This invention relates generally to walking canes, and, more particularly, to an apparatus for facilitating grasping and lifting small objects with a walking cane.

2. Summary of the Related Art

While canes are well know for providing support and stability for individuals having difficulty walking, it is understood that many individuals requiring the use of a cane for walking lack an ability to bend over and retrieve small objects from the floor or ground. Therefore, a number of canes have been described in the patent art to provide an individual using the cane with apparatus, forming a permanent part of the cane, providing a gripping mechanism for grasping small objects at the foot of the cane and an actuation mechanism for operating the gripping mechanism near the handle of the cane.

For example, U.S. Pat. Nos. 5,392,800, 5,636,650 and 5,640,985 all describe hollow canes in which tension applied to a cable extending within the hollow cane body causes a grasping arm pivotally mounted near the lower rubber tip of the can to pivot inward, closing a gap against the rubber cane tip to grasp an object, with a spring also attached to the grasping arm being used to pivot the grasping arm outward, away from the cane tip, and to maintain tension within the cable. In the device of U.S. Pat. Nos. 5,392,800 and 5,640,985, the cable is pulled by pivoting a lever near the handle of the cane. In the device of U.S. Pat. No. 5,636,650, the cable is pulled by sliding a finger grip located below the cane handle, and a system of pulleys slidably mounted within the cane provides for operation of the grasping arm after the length of the cane is varied by sliding one tube within another.

U.S. Pat. No. 3,591,226 describes a gripping device, not a cane, having a tube, a shoehorn mounted at a distal end of the tube, and a pivotally mounted grasping arm which is pulled toward the shoehorn at the distal end of the tube by means of a cord extending within the tube. This patent also describes the use of a magnet at the distal end of the tube to attract magnetic metal objects.

Other patents describe a mechanism extending external to the body of the cane for moving a pivotally mounted grasping arm. In the device of U.S. Pat. No. 5,176,160, the grasping arm is pulled into contact with the rubber cane tip by means of a cable extending along the outside of the cane, with the cable being pulled by pivoting a lever near the crane handle. In the device of U.S. Pat. No. 4,966,316, a four-bar linkage external to the cane body is used, with a link extending between a crank moved by an actuating lever and a crank moving the grasping arm. In this device, a shaft extending from the lower tip of the cane body, holding a rubber tip to provide walking assistance, can be replaced with a shoehorn.

U.S. Pat. Nos. 3,467,116, 3,763,872, and 4,811,780 describe canes having grasping mechanisms that are formed to extend radially outward from the distal end of the cane, and which are deflected radially inward by being pulled upward, into a tube or a pair of holes, or by having a tube pulled downward over the grasping mechanism. For example, U.S. Pat. No. 3,467,116 describes a tubular cane including a pair of grasping fingers, which are held apart by a spring and which are held together by the tube of the cane. The grasping fingers are attached by a rod extending within the tube to a sliding sleeve near the handle. When the rod is moved downward, the fingers are moved apart as they are extended from the end of the tube. When the rod is then moved upward, the fingers are pulled together, grasping an object lying between them. In the device of U.S. Pat. No. 3,763,872, vertical movement of a post slidably mounted within a tubular cane is used to open and close the fingers. In the device of U.S. Pat. No. 4,811,750, the two fingers move outward through holes in the distal end of the cane, with the holes being arranged to allow increasing outward movement of one of the fingers as they are moved downward by a spring. The fingers are returned into the cane by pressing downward on the cane with at least one of the fingers on the ground, and with the object to be grasped between them.

U.S. Pat. No. 5,707,303 describes a cane configured particularly for retrieving, grasping, and setting golf balls and tees.

Another approach to provide a cane having an ability to pick up objects from a floor is described in U.S. Pat. No. 4,527,824, in the form of a hollow cane having an internal battery, motor, and a fan to produce a vacuum drawing air through an inverted cup at the bottom of the cane.

All to the patents described above require structural differences between the cane being described and a conventional cane to an extent that a conventional cane cannot be readily modified to perform in accordance with the described invention. What is needed is a grasping apparatus that can be applied to a conventional cane, which is not otherwise modified, with the apparatus providing the grasping function. Preferably, such apparatus can also be removed to restore the cane to its previous condition, and then reinstalled on the cane or on another cane.

U.S. Pat. No. 4,827,956 describes a cane having an attached switch and reversible motor drive mechanism turning a screw to close and open a pair of opposed jaw-like gripping members.

What is needed is a simple apparatus, removably attachable to a conventional cane, to transfer a mechanical movement from an area near the handle to a gripping mechanism at the cane tip.

DETAILED DESCRIPTION OF THE INVENTION

Figure 1:
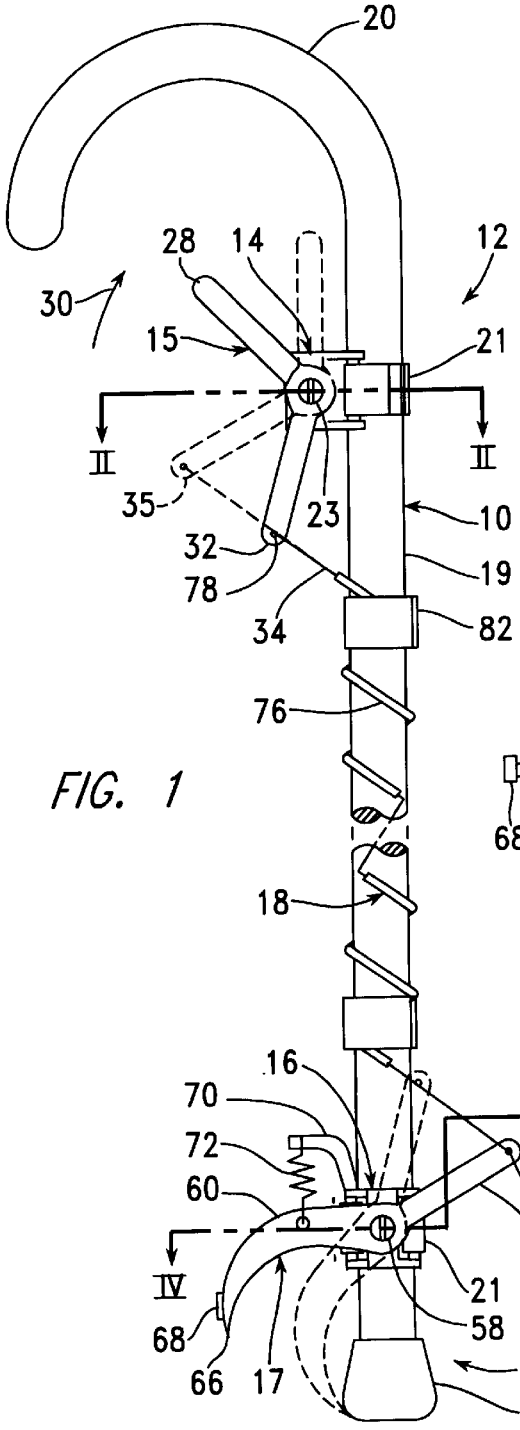
FIG. 1 is a side elevation of a cane including an attached apparatus built in accordance with a first embodiment of the present invention.

FIG. 1 is a side elevation of a cane 10, which may be of a conventional type, having attached thereto various elements forming an apparatus 12 built in accordance with a preferred version of the present invention to provide an object grasping function in addition to the function of providing physical stability for the user when he is walking or standing. The apparatus 12 includes a first mounting block 14 pivotally mounting an actuator 15, a second mounting block 16 pivotally mounting a grasping member 17, and a sheathed cable mechanism 18 transmitting motion between the actuator 15 and the grasping member 17.

Figure 2:
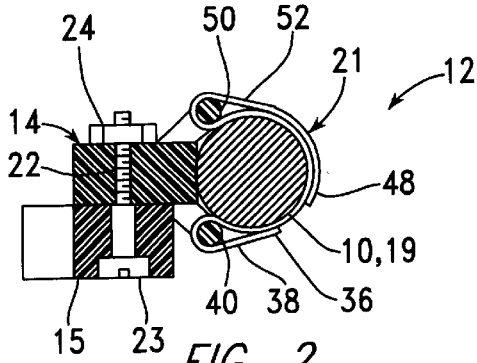
FIG. 2 is a first cross-sectional plan view of the cane and attached apparatus of FIG. 1, taken as indicated by section lines II—II through a first mounting block therein.

FIG. 2 is a cross-sectional plan view of the cane 10, taken in the direction of section lines II—II through the cane 10 and through the first mounting block 14 within the apparatus 12 attached to an elongated portion 19 of the cane 10, near the handle portion 20 thereof, by means of an attachment strap 21.

Referring to FIGS. 1 and 2, the first mounting block 14 includes a hole 22 into which a pivot screw 23 is fastened by means of a nut 24 to pivotally mount the actuator 15. The actuator 15 includes a handle arm 28, which is pivoted by manually applied pressure in the direction of arrow 30 to pick up an object in a manner to be described herein, and a crank arm 32, which pivots with the handle arm 30 to pull an attached cable 34 as the actuator 26 is moved from the position in which it is shown to the position indicated by dashed lines 35.

Figure 3:
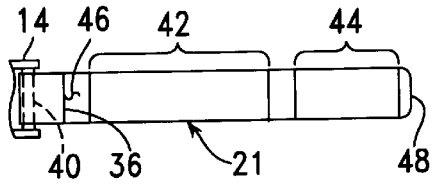
FIG. 3 is fragmentary side elevation of the first mounting block of FIG. 2, showing an attachment strap in a stretched out orientation.

FIG. 3 is a fragmentary side elevation of the first mounting block 14 and the attachment strap 21, which is stretched out to show the locations of materials applied to the strap 21 to form surfaces that are easily attached to one another.

Referring to FIGS. 2 and 3, an end 36 of the attachment strap 21, which is preferably composed of a flexible thermoplastic resin or of a textile material, is fastened, for example by sewing, to form a loop 38 around a post 40, which is a portion of the first mounting block 14. A.first fastening section 42, composed of a first type of fastening material, and a second fastening section 44, composed of a second type of fastening material, are attached to an outer surface 46 of the attachment strap 21. The first and second types of fastening material are readily and removably attached to one another. For example, the first type of fastening material is a loop-type material, and the second type of fastening material is a hook-type material, both of which are sold for use with one another under the trademark VELCRO. To further prevent slipping, the surfaces of the first mounting block 14 and the attachment strap 21 coming into contact with the elongated portion 19 may be coated with an elastomeric material.

Figure 4:
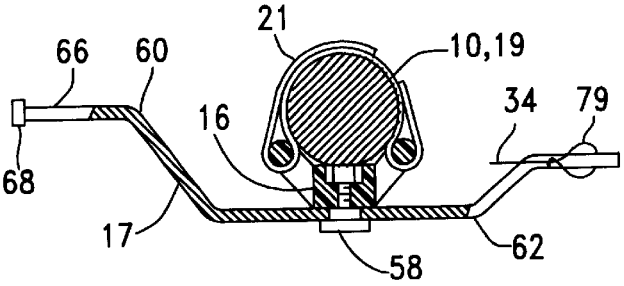
FIG. 4 is a second cross-sectional plan view of the crane and attached apparatus of FIG. 1, taken as indicated by section lines IV—IV through a second mounting block therein.

The first mounting block 14 is attached to the elongated portion 19 of the cane 10 by pulling an end 48 of the attachment strap 21 around a second post 50 that is a part of the block 14, as the block 14 in place against the elongated portion 19, to form a loop 52 in the strap 21. With tension being applied to the end 48 of the strap 21, the second fastening section 44 is then pressed in place over the first fastening section 42, to complete the attachment process. For example, the loop- and hook-type materials described above strongly resist separation in shear while permitting separation in tension and attachment in compression. FIG. 4 is a cross-sectional plan view of the cane 10, taken in the direction of section lines IV—IV through the cane 10 and through a second mounting block 16 within the apparatus 12 attached to an elongated portion 19 of the cane 10, near the distal end 56 thereof. In the example of FIG. 4, the second mounting block 16 is removably attached to the elongated portion 19 by means of another attachment strap 21, in the manner described above in reference to FIGS. 2 and 3.

Referring to FIGS. 1 and 4, the second mounting block 16 pivotally mounts the grasping member 17 by means of a pivot screw 58. The grasping member 17 includes a grasping arm 60 and a crank arm 62. As the crank arm 62 is pulled by the cable 34 in response to the pivoting of actuator 28 in the direction of arrow 30, the grasping member 17 is pivoted in the direction of arrow 64, bringing a tip 66 of the grasping member 17 into contact with a rubber tip 67 at the distal end 56 of the elongated cane member 19. As shown particularly in FIG. 4, while the grasping member 17 extends past one side of the elongated portion 19, the grasping arm 60 is preferably formed to offset the tip 66 into approximate alignment with the center of the elongated portion 19, and the crank arm 62 is preferably formed to offset the cable 34 attached thereto into approximate alignment with an outer surface of the elongated portion 19, around which the sheathed cable mechanism 18 is wrapped. Preferably, the tip 66 is also provided with a permanent magnet for attracting magnetic objects. This either may be in the form of an adhesively attached magnet 68 or, if the grasping arm 60 is formed of a suitably hard magnetic material, in the form of a magnetic structure formed within the material of the arm 60 by electromagnetic induction.

The second mounting block 16 preferably also includes a spring mounting arm 70, by which an extension spring 72 is attached to the grasping arm 60. This spring 72 applies a torque acting in a direction opposite that of arrow 64 to the grasping member 17, so that the grasping arm tip 66 is held away from the rubber tip 67 when pressure is not applied to the handle arm 28 of the actuator 15.

The sheathed cable mechanism 18 includes the cable 34 sliding within a tubular sheath 76. One end of the cable 34 is attached to extend as a loop through a hole 78 within the crank arm 32 of the actuator 15, and the other end of the cable 34 is attached to extend as a loop 79 through a hole 80 in the crank arm 62 of the grasping member 17. Preferably, both the cable 34 and the tubular sheath 76 exhibit flexibility in flexure while resisting extension and compression. For example, the cable 34 is composed of a metallic strands covered with an extruded thermoplastic outer layer, while the tubular sheath 76 is composed of an extruded thermoplastic resin. This mechanism readily transmits motion from one end of the cable 34 to the other as long as both ends of the tubular sheath 76 are held to a rigid structure, despite changes in the shape of the sheathed cable mechanism 18 between its ends. In the first embodiment 10, each of the ends of the cable sheath 76 is held in place on the rigid elongated cane portion 19 by means of a clamping strap 82.

Figure 5:
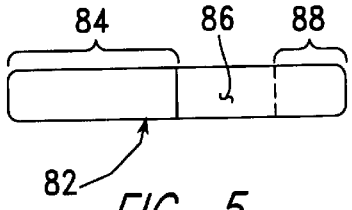
FIG. 5 is a side elevation of a clamping strap in the attached apparatus of FIG. 1.

FIG. 5 is an elevation of the clamping strap 82, which is composed, for example, of a flexible thermoplastic material or of a textile material, in a stretched out condition. A first fastening section 84, composed of a first type of fastening material is attached to an outer surface 86 of the clamping strap 82, and a second fastening section 88, composed of a second type of fastening material, is attached to an inner surface, opposite the outer surface 86 of the clamping strap 82. The first and second types of fastening material are readily and removably attached to one another. For example, the first type of fastening material is a loop-type material, and the second type of fastening material is a hook-type material, both of which are sold for use with one another under the trademark VELCRO. To further prevent slipping, the surfaces of the clamping strap 82 coming into contact with the elongated portion 19 may be coated with an elastomeric material. As shown in FIG. 1, an attachment strap 82 is wrapped around both the elongated cane portion 19 and the sheathed cable mechanism 18 near each end of the tubular sheath 76, with the second fastening section 88 being fastened to the first fastening section 84.

Figure 6:
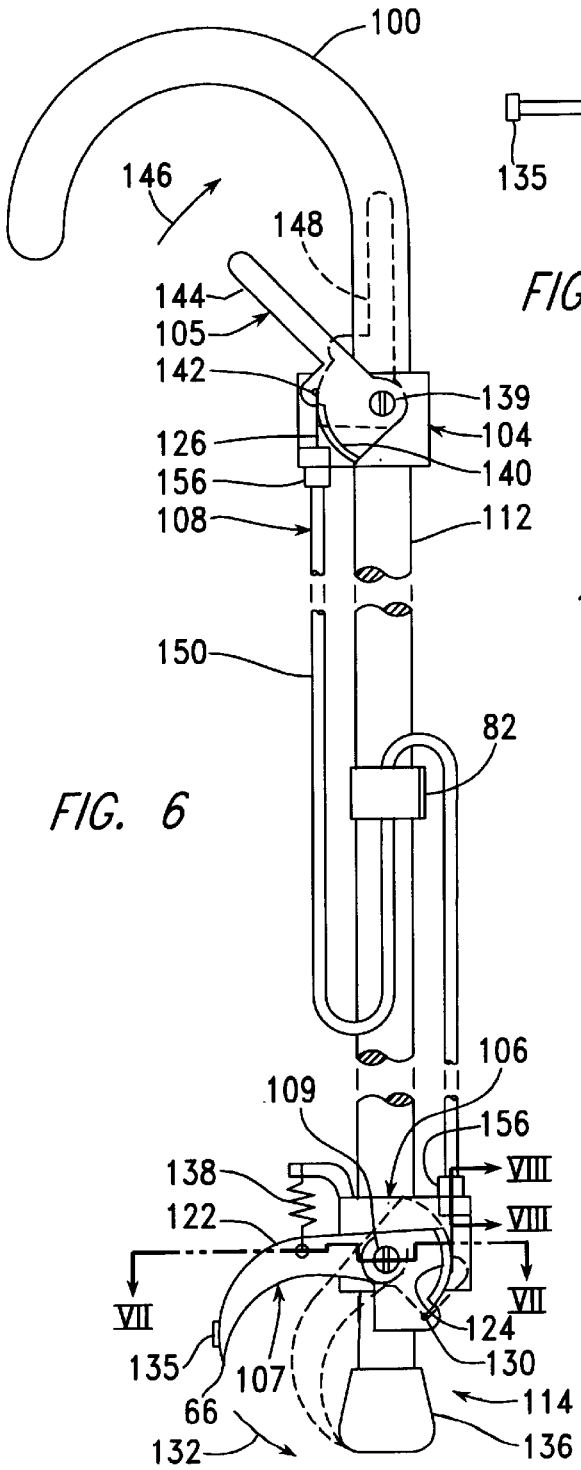
FIG. 6 is a side elevation of a cane including an attached apparatus built in accordance with a second embodiment of the present invention.

FIG. 6 is a side elevation of a cane 100 having attached thereto various elements forming an apparatus 102 built in accordance with a second embodiment of the present invention. The apparatus 102 includes a first mounting block 104 pivotally mounting an actuator 105, a second mounting block 106 pivotally mounting a grasping member 107, and a sheathed cable mechanism 108 transmitting motion between the actuator 105 and the grasping member 107.

Figure 7:
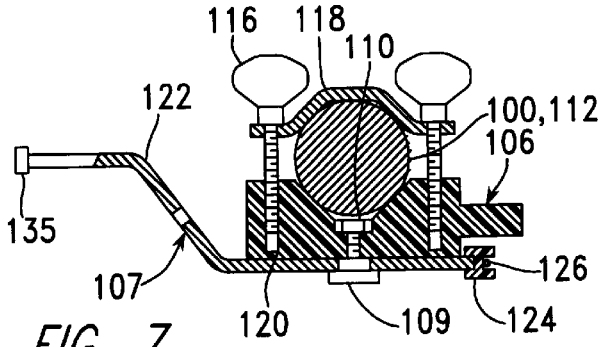
FIG. 7 is a cross-sectional plan view of the cane and attached apparatus of FIG. 6, taken as indicated by section lines VII—VII through a second mounting block therein.

FIG. 7 is a cross-sectional plan view of the cane 100 taken as indicated by section lines VII—VII in FIG. 1 through the second mounting block 106 within the apparatus 102.

Referring to FIGS. 6 and 7, the grasping member 107 is pivotally mounted on the second mounting block 105 by means of a screw 109, which is fastened in place by a nut 110. The second mounting block 106 is in turn attached to an elongated portion 112 of the cane 100 by means of a pair of thumbscrews 116 extending through a clamping member 118 into threaded holes 120 within the second mounting block 106. The grasping member 107 includes a grasping arm 122 and an arcuate channel 126, within which a cable 126 of the sheathed cable mechanism 108 extends, being attached tin the form of a loop extending through a hole 130 within the grasping member 107. When the cable 126 is pulled, the grasping member 107 pivots in the direction of arrow 132 between the position in which it is shown and the position indicated by dashed lines 135. This motion is used (for example) to grasp an object (not shown) between the grasping arm 122 of the grasping member 107 and a rubber tip 136 at the distal end 114 of the cane 100. Preferably, the grasping arm 122 also includes a permanent magnet 135 to be used in picking up ferromagnetic objects. When the force pulling the cable 128 is released, an extension spring 138 pivots the grasping member opposite the direction of arrow 132.

The actuator 105, which is pivotally mounted on the first mounting block 104 by means of a screw 139, includes an arcuate channel 140. The cable 128 extends within this channel 140, being attached in the form of a loop extending through a hole 142 in the actuator 105. A handle arm portion 144 of the actuator 105 is manually moved in the direction of arrow 146, into the position indicated by dashed lines 148, to pull the grasping member 107 in the direction of arrow 132 by means of the cable 128.

Figure 8:
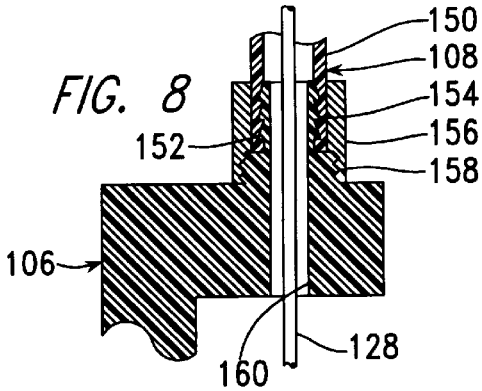
FIG. 8 is a fragmentary cross-sectional elevation of the second mounting block in the attached apparatus of FIG. 6, taken as indicated by section lines VIII—VIII to show a structure fastening a tubular sheath to the second mounting block.

FIG. 8 is a fragmentary side elevation of the apparatus 102, taken as indicated by section lines VIII—VIII in FIG. 6 to show a connection made between a tubular sheath 150 of the sheathed cable mechanism 108 and the second mounting block 106. An end of the tubular sheath 150 extends over a connecting portion 152 extending outward from the second mounting block 106. The outer surface of the connecting portion 152 includes a number of gripping surfaces 154, which aid in holding the tubular sheath 150 in place. A ferrule 156, engaging threads 158 of the second mounting block 106 also aids in holding the tubular sheath 150 in place. The cable 126 extends through a hole 160 in the second mounting block 106.

Figure 9:
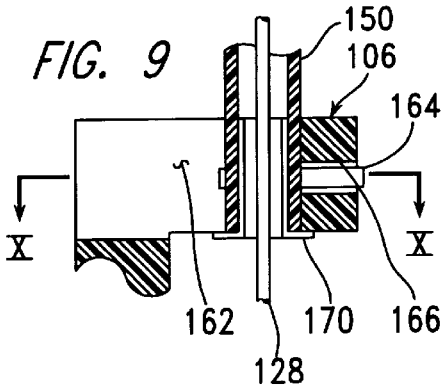
FIG. 9 is a fragmentary cross-sectional elevation, similar to FIG. 8, showing an alternative structure for fastening the tubular sheath to the second mounting block.
Figure 10:
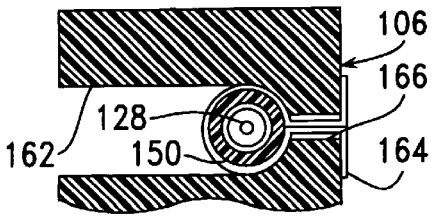
FIG. 10 is a fragmentary cross-sectional elevation of the alternative structure of FIG. 9, taken as indicated by section lines X—X therein.

FIGS. 9 and 10 are fragmentary cross-sectional elevations showing an alternative structure for fastening the tubular sheath 150 into the second mounting block 106, with FIG. 9 being taken in a manner similar to FIG. 8, and with FIG. 10 being taken as indicated by section lines X—X in FIG. 9. In this alternative structure, the tubular sheath 150 extends into a slot 162 within the second mounting block 106, being held in place by a formed clip 164, extending into the slot 162 through a hole 166. An eyelet 170 prevents the collapse of the tubular sheath 150, so that the cable 126 is allowed to move freely.

Referring to FIGS. 1 and 6, since canes vary in length, the sheathed cable mechanism 18 or 108 is expected to be too long to be stretched tightly between the actuator 15 or 105 and the grasping member 17 or 107. Preferably, the sheathed cable mechanism 18 or 108 is fabricated to form a length suitable for one of the longest canes in common use. For use with a shorter cane, the sheathed cable mechanism 18 or 108 may cut to a shorter length, or the methods shown in the figures may be used to accommodate the additional length, with the cable being wrapped in a spiral around the elongated portion 19 of the cane, as shown in FIG. 1, or with a central looping portion being formed as shown in FIG. 6. One or more additional attachment straps 82 may be used, for example, in the manner shown in FIG. 6 to hold the sheathed cable mechanism 18 or 108 in place.

The methods for attaching the second mounting block 106 to the elongated cane portion 112 and for attaching the tubular sheath 150 to the second mounting block 106 have been described in detail above. It is understood that these methods are also used to attach the first mounting block 104 to the elongated cane portion 112 and for attaching the tubular sheath 150 to the first mounting block 104.

Preferably, the apparatus 12 or 102 is provided in a kit form, to be installed on a cane by a user. The sheathed cable mechanism 18 or 108 may be supplied as a separate structure, with the cable 34 or 128 being tied the actuator 15 or 105 and to the gripping member 17 or 107 by the user. Altemately, the apparatus 12 or 102 may be provided with the cable 34 or 128 tied to the actuator 15 or 105 and to the gripping member 17 or 107, and, in the case of the apparatus 102, with the tubular sheath 150 also connected to the first mounting block 104 and to the second mounting block 108.

While the invention has been described in its preferred forms or embodiments with some degree of particularity, it is understood that this description has been given only by way of example, and that numerous changes in the form and arrangement of parts may be made without departing from the spirit and scope of the invention. For example, a system may be made using various elements of the first and second embodiments, such as the clamping mechanism using thumbscrews 116 of FIG. 7 together with the spiral winding of the sheathed cable mechanism 18 and its attachment to the elongated cane portion 18 as shown in FIG. 1.

What is claimed is:

1. Apparatus for attachment to a cane, comprising:

a first mounting block;

an actuator movably mounted to said first mounting block;

a second mounting block;

first attachment means for attaching said mounting blocks to said cane;

a grasping member including a grasping tip, wherein said grasping member is mounted on said second mounting block to move between an open position having said grasping tip spaced apart from said cane and a closed position having said grasping tip held against said cane;

a flexible tube;

a cable, slidable within said flexible tube, wherein a first end of said cable is attachable to said actuator, and wherein a second end of said cable is attachable to said grasping member; and second attachment means for holding opposite ends of said flexible tube in place adjacent said first and second mounting blocks.

2. The apparatus of claim 1, wherein said actuator is pivotally mounted to said first mounting block.

3. The apparatus of claim 1, wherein said first attachment means includes:

a first flexible strap attached to said mounting block and extendable around said cane; and fastening means for holding said first flexible strap tightly around said cane.

4. The apparatus of claim 1, wherein said first attachment means includes:

a clamping member; and a fastener for adjustably holding said clamping member on a side of said cane opposite said mounting block.

5. The apparatus of claim 1, wherein said grasping member is pivotally attached to said second mounting block.

6. The apparatus of claim 1, wherein said grasping member includes a permanent magnet adjacent said grasping tip.

7. The apparatus of claim 3 wherein said first attachment means includes a second flexible strap extendable around said cane; and fastening means for holding said second flexible strap tightly around said cane.

8. The apparatus of claim 1, wherein said second attachment means includes:

a hole extending into said mounting block for receiving an end of said flexible tube, and a clip extending around said end of said flexible tube holding said flexible tube within said hole.

9. The apparatus of claim 1, wherein said second attachment means includes:

a tubular portion extending outward from said mounting block for receiving an end of said flexible tube; and a ferrule attachable over said tubular portion to hold said end of said flexible tube in place over said tubular portion.

10. A cane adapted for grasping objects, comprising:

a handle;

an elongated member extending from said handle to a distal end of said elongated member;

a first mounting block;

an actuator movably mounted to said first mounting block;

a second mounting block;

first attachment means for attaching said mounting blocks to said cane;

a grasping member including a grasping tip, wherein said grasping member is mounted on said second mounting block to move between an open position having said grasping tip spaced apart from said cane and a closed position having said grasping tip held against said cane;

a flexible tube;

a cable, slidable within said flexible tube, wherein a first end of said cable is attachable to said actuator, and wherein a second end of said cable is attachable to said grasping member; and second attachment means for holding opposite ends of said flexible tube in place adjacent said first and second mounting blocks.

11. The cane of claim 10, wherein said actuator is pivotally mounted to said first mounting block.

12. The cane of claim 10, wherein said first attachment means includes:

a first flexible strap attached to said mounting block and extendable around said cane; and fastening means for holding said first flexible strap tightly around said cane.

13. The cane of claim 10, wherein said first attachment means includes:

a clamping member; and a fastener for adjustably holding said clamping member on a side of said cane opposite said mounting block.

14. The cane of claim 10, wherein said grasping member is pivotally attached to said second mounting block.

15. The cane of claim 10, wherein said grasping member includes a permanent magnet adjacent said grasping tip.

16. The cane of claim 12, wherein said first attachment means includes a second flexible strap extendable around said cane; and fastening means for holding said second flexible strap tightly around said cane.

17. The cane of claim 10, wherein said second attachment means includes:

a hole extending into said mounting block for receiving an end of said flexible tube, and a clip extending around said end of said flexible tube holding said flexible tube within said hole.

18. The cane of claim 10, wherein said second attachment means includes:

a tubular portion extending outward from said mounting block for receiving an end of said flexible tube; and a ferrule attachable over said tubular portion to hold said end of said flexible tube in place over said tubular portion.

* * * * *